United States Patent [19]

Riegelman et al.

[11] 4,064,592

[45] Dec. 27, 1977

[54] RETAINER FOR SLIDING DOORS AND THE LIKE

[75] Inventors: Harry M. Riegelman, Fullerton; Vernon Edwin Madison, Orange, both of Calif.

[73] Assignee: Rusco Industries, Inc., Fullerton, Calif.

[21] Appl. No.: 688,050

[22] Filed: May 19, 1976

[51] Int. Cl.[2] ..... E05D 13/02

[52] U.S. Cl. ..... 16/100; 49/425

[58] Field of Search ..... 16/90, 91, 97, 100, 16/104, 106, 105; 49/425, 452

[56] References Cited

U.S. PATENT DOCUMENTS

| | | | |
|---|---|---|---|
| 809,695 | 1/1906 | Keil | 16/100 |
| 809,696 | 1/1906 | Keil | 16/97 |
| 1,780,755 | 11/1930 | Kurtzon | 16/100 |
| 2,659,939 | 11/1953 | Greig | 16/100 X |
| 2,912,714 | 11/1959 | Rich | 16/100 |
| 3,097,401 | 7/1963 | Riegelman | 16/100 X |
| 3,137,028 | 6/1964 | Steigerwald | 16/105 |
| 3,284,953 | 11/1966 | Rifkin | 16/91 X |
| 3,956,854 | 5/1976 | Yamamoto | 16/100 X |

*Primary Examiner*—Werner H. Schroeder

*Assistant Examiner*—Moshe I. Cohen

*Attorney, Agent, or Firm*—Perry E. Turner

[57] ABSTRACT

Wheels for movement along a floor-mounted track at the bottom of a sliding door are shown supported within U-shaped members which are pivotally coupled to brackets secured to the lower edge of the door. The wheels are prevented from being dislodged from the track via retainer elements, each of which is a channel element having an elongated opening in its web and inturned flange terminations at the edges of its walls. An integral plate extends from one side of the channel and is pivotally mounted on the pin or stub shaft extending through the wheel and U-shaped member. The retainer element is significantly longer than the diameter of the wheel, and the flange terminations are snapped over the track and in interference relation with lips of the track. The wheel at its lower portion extends through the opening in the retainer element and rides on the track. When the door is tilted or rocked, the flange terminations remain interlocked with the lips of the track, thereby keeping the wheel on the track while permitting the U-shaped member to pivot on the wheel and the bracket to pivot on the U-shaped member in accommodating the relatively non-parallel relations of the door and track.

1 Claim, 3 Drawing Figures

RETAINER FOR SLIDING DOORS AND THE LIKE

BACKGROUND OF THE INVENTION

1. Field of the Invention

This invention relates to sliding doors and the like, and more particularly to structures for effecting movement of the lower edges of such doors along floor-mounted tracks.

2. Description of the Prior Art

It is conventional to hang a sliding door for movement on upper rollers, and to provide wheels on the bottom of the door to ride on a floor-mounted rail. It is well known that such doors are easily dislodged from their bottom rails, as when a wardrobe door is released while being forcibly shoved by hand from closed position towards the opposite jamb. The result in many instances is that the door is damaged, wheels broken and other parts in need of maintenance. To minimize such incidents and the time, effort and expense involved in repairs and replacement, attempts have heretofore been made to provide a mechanism for keeping such a door from being dislodged from the floor track. In the closest known art in this regard, a plate is secured to the pin or stub shaft on which the wheel is mounted, and a lip or flange on the lower edge of the plate engages a lip on one side of the rail. Such a device is unable to accomodate or compensate for situations wherein the track and the lower edge of the door are not parallel when the door is stationary, and it is easily broken or damaged when the door is subjected to force tending to lift it off the rail. Further, such a device as known has substantial friction with the rail during normal movements of the door where the rail is not parallel to the bottom of the door, whereby the door moves easily at one end of the track but requires the application of an undesired amount of force to move it along the opposite end of the track.

SUMMARY OF THE INVENTION

This invention embraces door retaining means wherein a channel-like element has an elongated opening in its web to receive a wheel adapted to ride on a floor-mounted track or rail, sides for straddling the rail, inturned flange terminations for the sides for engaging lips of the rail to prevent the element from being removed therefrom, such flange terminations normally having slight clearance with respect to the lips of the rail, and an integral plate extending above one side of the element and pivotally supported on the axis of the wheel.

DESCRIPTION OF PREFERRED EMBODIMENT

Figure 1:
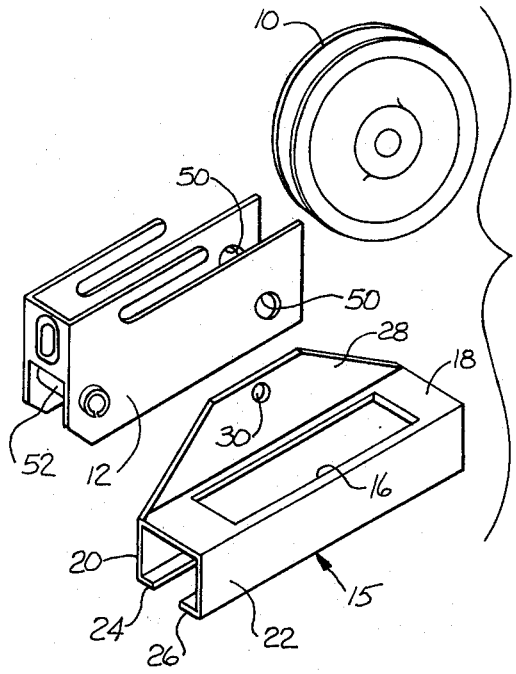
FIG. 1 is an exploded view of parts of an assembly including the retaining element in accordance with this invention.
Figure 2:
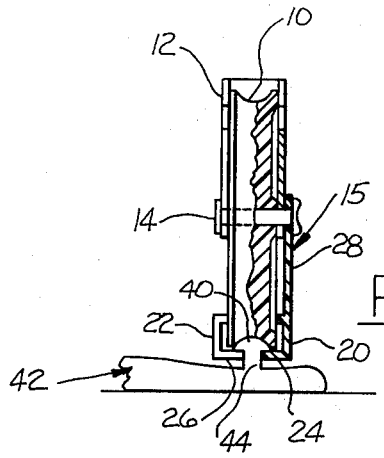
FIG. 2 is an end view of a track or rail on which the wheel of the assembly of FIG. 1 rides, showing the wheel and retaining element partly in section.

Referring to FIGS. 1 and 2, a wheel 10 is rotatably supported between the sides of a U-shaped member 12 on a pin or stub shaft 14. Also rotatably supported on the pin 14 is a retainer clip 15 which is formed as a channel having an elongated opening 16 in its web 18, and wherein its side walls 20, 22 terminate in inturned flanges 24, 26. The clip 15 has a plate extension 28 with an opening 30 to be slidably placed arouond the pin 14. Preferably the clip is formed of plastic.

FIG. 2 shows a floor-mounted track 40, which may be part of an extension 42 having a pair of such tracks for a pair of sliding doors. The track 40 is shown as having a semi-circular upper portion on an upstanding rib 44, and wherein the track has shoulder terminations at right angles to the rib 44. As shown, the sides 20, 22 of the clip 15 straddle the track 40, and the inturned flanges 24, 26 extend inwardly beneath the shoulders so as to be in interference relation with the shoulders and prevent the clip from being dislodged from the track. The wheel 10 extends through the opening 16 in the clip to rest on the track 40. Accordingly, since the clip cannot be dislodged from the track, the wheel also cannot be removed from it.

Figure 3:
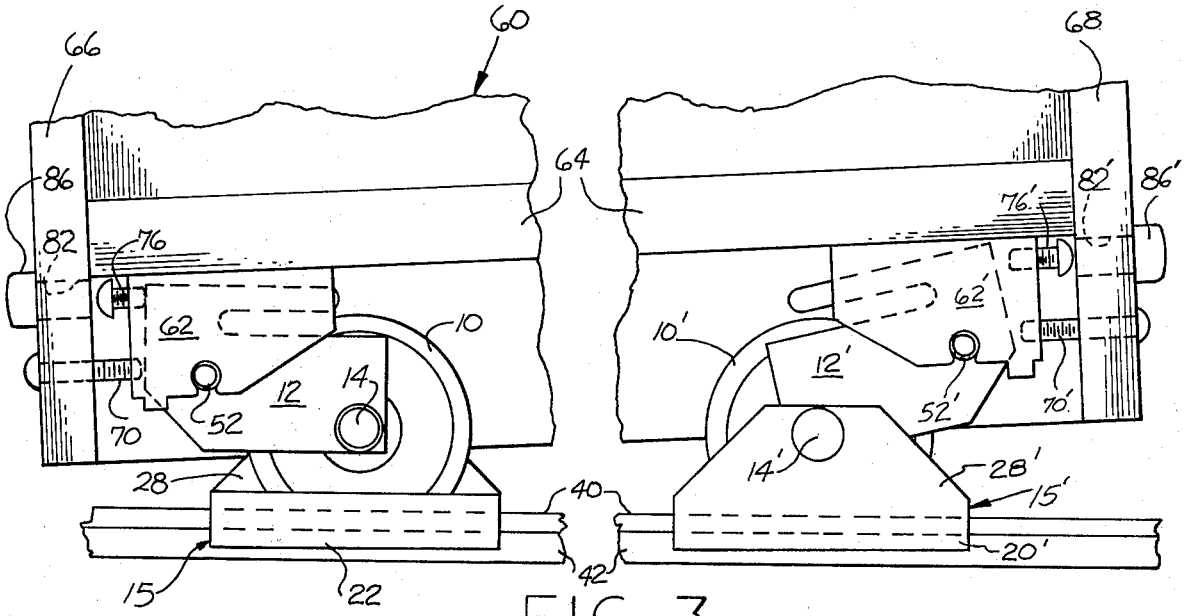
FIG. 3 is a fragmentary side elevation view of a sliding door adapted for movement along a floor-mounted track, showing the door tilted, and showing the pivotally mounted rataining elements keeping the wheels on the track while permitting the elements coupling the wheels to the bottom of the door to assume positions accommodating the tilted position of the door.

The U-shaped member 12 is angularly movable on the pin relative to the axis of the wheel 10, the pin 14 extending through openings 50 in the sides of the member 12. Such member 12 also has a roll pin 52 extending through its sides as shown in FIG. 1, and such roll pin is adapted to couple with a bracket for permitting relative angular movement between the member and bracket. Referring to FIG. 3, a door 60 is shown above the track 40, and a pair of assemblies as shown in FIG. 2 are located at the ends of the lower edge of the door. The two assemblies are the same, but for ease of explanation one assembly has its parts represented by primes of the numbers of the corresponding parts of the other assembly. Brackets 62, 62' are secured to the bottom rail 64 of the door, and such brackets are pivotal on the roll pins 52, 52' as above mentioned. Such roll pin and bracket coupling is disclosed in U.S. Pat. No. 3,137,028. Also, assemblies of wheels, U-shaped members and brackets as shown and described herein are disclosed in U.S. Pat. No. 3,097,401.

Also as disclosed in the last-mentioned patent, adjustment means are employed to facilitate initial alignment of the stiles 66, 68 of the door with the jambs (not shown). Such means include adjusting screws 70, 70' extending through the stiles and threaded into the adjacent lower portions of the brackets 62, 62'. Also, adjusting screws 76, 76' are threaded in the brackets 62, 62' and have their inner ends adapted to be engaged by the upper portions of the U-shaped members 12, 12'. With the screws 76, 76' inboard of the stiles as shown, access to them is effected by passing the end of a screwdriver through enlarged openings 82, 82' in the stiles, such openings normally being covered by bumpers 86, 86'.

When a door as shown is hung, the weight causes the clips 15, 15' to snap over the track 40. The sides 20, 22 and 20', 22' of such clips are sufficiently flexible and spring-like to permit the inturned flanges thereof to spread against the track 40 and snap around the shoulders thereof. After the door is initially adjusted to make the stiles parallel to the jamb, the clips 15, 15' function keep the wheels 10, 10' on the track 40.

In this latter regard, stability is enhanced by virtue of the clip structure being longer than the diameter of a wheel. With reference to the right hand portion of the door in FIG. 3, a tilting of the door due to sudden force readily is accommodated by angular movements of the U-shaped member 12' and bracket 62', the bracket being carried with the door and the member 12' per such movement without damage to parts by virtue of the roll pin coupling 52' and the pivotal movement of the member 12' on the wheel pin 14'. Since the clip 15' remains in place on the track 40, it keeps the wheel 10' on the track and thereby facilitates the relative pivotal movements of the member 12' and bracket 62'. The length of the clip 15' insures that it will not be forcibly separated from the track due to the distribution of the lifting force against the pin 14' throughout the lengths of the inturned flanges of the clip contacting the shoulders of the track.

We claim:

1. In a sliding door construction operable along a floor mounted track having shoulders on both sides thereof, wherein a bracket is secured to the bottom of the door at each end, retainer means for each end of the door comprising:

a wheel engaging the top of the track and having an axial pin;

an elongated door clip pivotally mounted adjacent one one of its ends to said axial pin and pivotally supported at its other end by the bracket;

and a track clip including a channel substantially longer than the diameter of said wheel, said channel having a web between parallel sides, said sides having inturned flanges, said channel having an elongated opening in its web surrounding the portion of the wheel engaging the track, a vertical plate extension from one of said sides, the upper edge of said extension being substantially shorter than the diameter of said wheel, said extension being pivotally mounted on said axial pin, said channel sides being spring-like to permit said flanges to be spread to straddle the track and snap into engagement with the shoulders thereof, whereby said track clip can remain clipped to the track to keep the wheel engaging the track when the door clip pivots to accommodate vertical movement of the door which makes the bottom of the door non-parallel to the track.

* * * * *